US010203181B1

(12) United States Patent
Choi

(10) Patent No.: US 10,203,181 B1
(45) Date of Patent: Feb. 12, 2019

(54) VIRTUAL TRAINING VIDEO SCREEN APPARATUS FOR SHOOTING LIVE AMMUNITIONS

(71) Applicant: Hae-Yong Choi, Seoul (KR)

(72) Inventor: Hae-Yong Choi, Seoul (KR)

( * ) Notice: Subject to any disclaimer, the term of this patent is extended or adjusted under 35 U.S.C. 154(b) by 0 days.

(21) Appl. No.: 15/792,954

(22) Filed: Oct. 25, 2017

(51) Int. Cl.
*F41G 3/26* (2006.01)
*F41J 7/04* (2006.01)
*F41J 1/10* (2006.01)

(52) U.S. Cl.
CPC ..... *F41G 3/2694* (2013.01); *F41J 1/10* (2013.01); *F41J 7/04* (2013.01)

(58) Field of Classification Search
CPC ..... F41G 3/26; F41G 3/2655; F41G 3/2694; F41J 1/00; F41J 1/10; F41J 7/04; F41J 5/14; F41J 13/00; F41J 13/02
See application file for complete search history.

(56) References Cited

U.S. PATENT DOCUMENTS

2017/0059283 A1* 3/2017 Parrish ..... F41J 1/10

FOREIGN PATENT DOCUMENTS

| | | | |
|---|---|---|---|
| JP | 2000009396 | A | 1/2000 |
| KR | 10-0651658 | B1 | 12/2006 |
| KR | 10-1017144 | B1 | 2/2011 |

* cited by examiner

*Primary Examiner* — Timothy A Musselman
(74) *Attorney, Agent, or Firm* — Bacon & Thomas, PLLC

(57) ABSTRACT

A video screen apparatus for hitting, including a first rotation rod on which a screen fabric is wound, and a second rotation rod having rotation rings are provided at both left and right sides, in which the first rotation rod is provided below a support in a horizontal direction, the second rotation rod is provided above the support in the horizontal direction, the screen is formed between a first support rod and a second support rod, a screen mounting board for mounting and separating the first rotation rod is provided below the support in the horizontal direction, a rotation support for mounting and separating the second rotation rod is provided above the support in the horizontal direction, and the second rotation rod provided above the support is configured by a separation and joining means configured to separate and join the second rotation rod from and to a motor.

7 Claims, 10 Drawing Sheets

VIRTUAL TRAINING VIDEO SCREEN APPARATUS FOR SHOOTING LIVE AMMUNITIONS

The present invention relates to a rotary rolling screen apparatus for a hitting capable of performing a virtual training while watching a screen mainly by shooting live ammunitions, and more particularly, to a virtual training video screen apparatus for shooting live ammunitions, which is configured in an impact absorption plate structure in which a screen of which the surface is damaged by hitting is immediately rotated and replaced and is enabled to be instantly mounted and instantly separated and energy and heat of a bullet penetrating the screen and a structure capable of cooling an impact absorption plate which is heated during multi-shot shooting.

BACKGROUND OF THE INVENTION

The present invention is useful for ammunition shooting training.

An ammunition moving speed of a rifle is very fast at approximately 600 to 1000 m/s and has a high rotational speed and is in a high temperature state momentarily at the time of shooting.

However, the sense of presence, reaction, and tension of the ammunition shooting can not be compared through a simulated ray gun.

Therefore, a user should perform training while actually feeling tension caused by the ammunition shooting, an environment when actually using reaction ammunitions, and the resulting tension.

In the case of screen golf, a velocity of a golf ball hit on a screen is close to 300 km/h, so the screen must be replaced occasionally due to a surface impact.

In this case, the screen is stopped to be used and a work that takes out a whole screen is manually.

In the case of screen baseball, the velocity of a hit baseball is also 100 to 200 k, and the size of the ball also causes a bigger hitting surface. This also causes a problem in that the screen needs to be manually replaced.

In a screen unit, a bullet mark is generated on a front screen after shooting and generated again on a back surface, resulting in double bullet marks and a negative effect in which support force of the screen is weakened and the screen is cut off frequently occurs. Therefore, a negative effect in which the shooting stops and the screen needs to be linked again occurs. Especially, automatic rifle firearms cannot be used for practice such as continuous shooting.

All technologies of Korean Patent Application No. 10-2004-0028423, Screen Shooting Apparatus by Laser Coordinate of Korean Patent Application No. 10-2009-0127846, and Japanese Patent Unexamined Publication No. 12009396, and Korean Patent Application No. 10-2004-0028423 are configured in a structure in which a release roller is disposed on a back surface of a rolling roller and a lower roller is used therebelow, that is, a structure in which three rollers are provided and the screen moves dually forward and backward.

In particular, a purpose of the technology such as Korean Patent Application No. 10-2009-0127846 is simply to continuously check a zero point adjustment state of the firearm using a shooting record after the shooting.

In addition, the structure is constituted by a screen unit and a bullet recovery unit in which the screen is continuously replaced, and a roller structure is constituted by a chain part in which three rollers of the release roller, the rolling roller, and a weight roller are interconnected and a driving part.

Therefore, when a used screen is replaced by the unit of the roller, all of three rollers should be disassembled. When in the process of the replacement, a chain of the rolling roller and the release roller should be dismantled and almost all components should be disassembled such as disassembling the chain of the rolling roller and the release roller, disassembling each rotation gear engaged in the chain and thereafter, disassembling a soup cut and a driving soup cut, etc., a screen fabric is exchanged at last, which results in a restriction of a use time.

In addition, there is a bullet recovery unit on the back surface of the screen. However, since the bullet is configured to be present in the recovery unit after passing through the screen, and as a result, there is a problem that such a recovery unit should also be separately disassembled in order to replace the screen.

In addition, since a lower roller is not a structure fixed between front and rear screens at a lower end but a structure which floats in the air at a bending point of the screen, the front and rear screens may be shaken at each shooting so that an image projected by a projector cannot be focused and the image is not unclear, and as a result, an image observation and scanning reading apparatus such as a camera, or the like cannot be applied to a screen surface in addition to free laser shooting at a focus distance.

In particular, since the screen cannot maintain flatness due to such a reason, it is possible to present only a simple target image and it is not possible to present various virtual situations such as terrorism and kidnapping. Since a projector does not focus on an image target, the image is blur and unclear and errors are constantly generated in a camera measuring device, etc. Further, since there is no separate sound absorbing device, noise during the hitting is large.

In addition, there is a bullet recovery unit that penetrates the screen, but the bullet recovery unit is simply configured by a trumpet tube with an opening and a single simple screen is provided on the front surface. Therefore, a safety accident may be led, in which an automatic machine that shoots continuously or a bullet which shoots in a rectangle which deviates from a straight position is still reflected and reacted in the trumpet tube and penetrates the screen on a rear surface again, which causes serious harm to a shooter.

In addition, in the case of the trumpet-type bullet recovery unit, a recovery unit having a simple trumpet tube structure which is impossible to installed indoor because shooting noise increases due to vibration of the trumpet tube and does not have a special device for reducing energy of shot bullets requires a large thickness and occupancy space, there is an obstacle cause in indoor installation and it is impossible for several shooting persons of multi-shot automatic firearms to perform shooting at the same time.

SUMMARY OF THE INVENTION

In order to enable shooting live ammunitions, it is necessary to provide rotating deceleration of rapid rotation of the live ammunitions, flight energy dissipation of the live ammunitions, prevention of a grenade, and a flame retarding and cooling structure due to a high temperature of the live ammunitions.

An aspect of the present invention may provide a structure which is configured in a structure which is enabled to frequently replacing a screen without disassembling constituent devices of the screen, enables an image of the screen to be accurately measured by maintaining flatness of the image as a state of the installed screen is continuously to be flat, prevents a bullet a from being made into the grenade by absorbing energy of the bullet a penetrating the screen rapidly and stopping and fixing a progress of the bullet a together with a block plate (8) structure, rapidly absorbs and distributes heat of the bullet a, and interrupts a reverse progress of the bullet penetrating an impact absorption plate structure, in order to accomplish an object of quickly and simply replacing the screen consumed due to a large number of rounds of shooting live ammunitions.

Another aspect of the present invention may provide a structure which enables successive or multiple shooting by rapidly cooling heat of an internal structure heated by the heat of the bullet which is input by successive or multiple shot.

According to the present invention, as illustrated in presented drawings, a second rotation rod 4 is provided below a first rotation rod 2 and each of each of the first rotation rod 2 and the second rotation rod 4 is connected to a screen 3.

A fabric of the screen is made of a film material such as urethane, PCT, or the like and an aluminum reflection surface is formed on a back surface of the screen fabric to display a stereoscopic image on the screen.

The first rotation rod 2 provided below the screen 3 is mounted on a screen mounting board 6 and the second rotation rod 4 is mounted on a rotation support 7 while a rotation ring 41 is attached to the upper second rotation rod 4 and a fixation table 42 connected to and separated from a motor 5 is provided at one end thereof.

A braking ring 61 configured by a magnet, or the like is configured in the screen mounting board 6 on which the upper second rotation rod 4 of the screen 3 is mounted and the rotation ring 41 such as a bearing is provided at both ends of the upper second rotation rod 4 of the screen 3.

Each of the screen mounting board 6 and the rotation support 7 is provided with a safety pin 22.

As illustrated in FIGS. 7 and 8C, 8D, 8E, and 8F, a structure of an impact absorption plate 9 provided on the back surface of the screen 3 is configured to be made into a block with a flame retardant material such as metal, or the like and an air inducing groove is configured by a lot of porous forms and a blocking plate 8 having high hardness such as a steel plate is configured on the back surface of the air inducing groove.

When dozens of hot bullets or more are simultaneously shot, the impact absorption plate 9 receiving the bullets and absorbing heat is inevitably heated. Therefore, the impact absorption plate 9 is joined with a cooling means in order to prevent fire.

Therefore, in the present invention, a screen 3 is rotated by using a remote controller or the like, and an image having a clear focus can be continuously provided in a flat screen 3 without a separate weight roll by an action of a braking ring 61 such as a magnet to both ends of a second rotation rod 4 and gravity by force rolled up by a first rotation rod on the top.

The heat and energy of the bullet a is absorbed while the bullet a of the shoot live ammunition passes through the impact absorption plate 9 by penetrating the screen 3 and the energy is absorbed and interrupted by a blocking plate 8 having high hardness, such as steel, ceramics, special steel, or the like, and the bullet a which stops on the blocking plate 8 does not become a grenade and a location of the bullet a is fixed on the impact absorption plate 9 to guarantee safety of a shooter and a surrounding and an impact absorption plate structure having a porous shape absorbs even noise during shooting.

A structure of the impact absorption plate 9 may be formed in a block shape as illustrated in FIG. 8A, so that only the structure of the impact absorption plate 9 can be simply separated, joined, and replaced in the structure of the present invention.

When a hot bullet is fired simultaneously for more than several tens of shots, since the heat of the heated impact absorption plate 9 is cooled by receiving the hot bullet and absorbing the heat, fire is enabled to be prevented, and as a result, the screen can be installed and multiple shooting is simultaneously enabled.

In addition, even when the used screen 3 is replaced, instantaneous joining and instantaneous separation of the screen 3 to and from a screen amounting board 6 and a rotational support 7 are enabled, in which a user can simply and instantaneously change the screen 3 only by means of releasing safety pins 22 only to the screen mount 6 and the rotation support 7.

A fabric of the mounted screen continuously maintains flatness, a projected image is focused on the clear image due to an accurate focal distance. Therefore, it is possible to measure the image by a camera, or the like and it is possible to scan and measure a shooting result, and it is possible to provide various images, thereby enabling various virtual trainings including providing various moving pictures that set a virtual training situation.

In addition, a polarizing reflective layer is formed on a back surface of the fabric of the screen to enable viewing of stereoscopic images and an image absorption device is configured on the back surface to absorb sound and impact due to hitting.

BRIEF DESCRIPTION OF THE FIGURES

The above and other aspects, features, and advantages in which:

FIG. 8A is a block explanatory diagram of an impact absorption plate.

FIG. 8B is an action explanatory diagram of the impact absorption plate.

FIG. 8C is an explanatory diagram of porous embodiment 1 of the impact absorption plate.

FIG. 8D is an explanatory diagram of porous embodiment 2 of the impact absorption plate.

FIG. 8E is an explanatory diagram of porous embodiment 3 of the impact absorption plate.

DETAILED DESCRIPTION OF THE INVENTION

Figure 1:
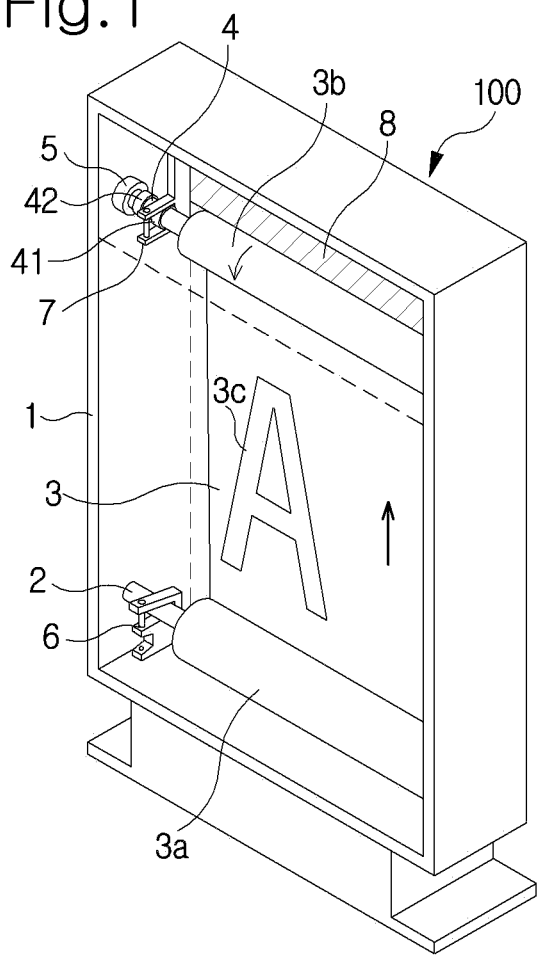
FIG. 1 is an exterior structural diagram in which the present invention is implemented.

As a feature of the present invention, as illustrated in FIGS. 1, 2A and 2B, and 3A-3C, a second rotation rod 4 is provided below a first rotation rod 2 and each of the first rotation rod 2 and the second rotation rod 4 is connected to a screen 3.

The first rotation rod 2 provided below the screen 3 is mounted on the screen mounting board 6 and the second rotation rod 4 is mounted on the rotation support 7 while a rotation ring 41 is attached to the upper second rotation rod 4 and a fixation table 42 connected to and separated from a motor 5 is provided at one end thereof.

A braking ring 61 configured by a magnet, or the like is configured in the screen mounting board 6 on which the upper second rotation rod 4 of the screen 3 is mounted and a rotation ring 41 such as a bearing is provided at both ends of the upper second rotation rod 4 of the screen 3.

Each of the screen mounting board 6 and the rotation support 7 is provided with a safety pin 22.

Therefore, in the present invention, a screen 3 is rotated by using a remote controller or the like, and an image may be continuously provided in a flat screen 3 without a separate weight roll by an action of a braking ring 61 such as a magnet to both ends of a second rotation rod 4 and gravity by force rolled up by a first rotation rod on the top.

In addition, even when the used screen 3 is replaced, instantaneous joining and instantaneous separation of the screen 1 to and from a screen amounting board 6 and a rotational support 7 are enabled, in which a user can simply and instantaneously change the screen 3 by releasing on the safety pin 22 to the screen mount 6 and the rotation support 7 and replacing only the first and second rotation rods 2 and 4.

Further, as illustrated in FIGS. 7 and 8C, 8D, 8D, and 8F, the structure of the impact absorption plate 9 provided on the back surface of the screen 3 is made to a block with a flame retarding material such as metal, or the like and is configured in a porous shape having a lot of air induction grooves and a blocking plate 8 having high hardness such as steel plate is formed on the back surface of the impact absorption plate 9, and as a result, the heat and energy of the bullet a is absorbed while the bullet a of the shoot live ammunition passes through the impact absorption plate 9 by penetrating the screen 3 and the energy is absorbed and interrupted by a blocking plate 8 having high hardness, such as steel, ceramics, special steel, or the like, and the bullet a which stops on the blocking plate 8 does not become a grenade and a location of the bullet a is fixed on the impact absorption plate 9 to guarantee safety of a shooter and a surrounding.

In addition, the impact absorbing plate structure having the porous shape has an effect of absorbing even noise during shooting.

The structure of the impact absorption plate 9 is formed in a block shape as illustrated in FIG. 8A, so that only the structure of the impact absorption plate 9 may be simply separated, joined, and replaced.

In the case of the temperature of the bullet, the temperature of the chamber rises up to 600° and an internal temperature of a gunbarrel rises up to 300° C. and a smokeless gunpowder ignition temperature of the bullet is known as approximately 180° C. Therefore, the temperature of the bullet going out of the air is lower than that of the impact absorption plate 9, but the impact absorption plate 9 receiving hot bullets and absorbs the heat when the hot bullet is fired simultaneously for more than several tens of shots at a short distance cannot but be heated. Therefore, joining with a cooling means is required for preventing fire.

Further, in the cooling system structure of FIG. 9, in order to cool rapidly generated heat, the cooling structure illustrated in FIGS. 9A, 9B, 9C, and 9D is joined to the impact absorption plate 9 or blocking plate 8 structure to prevent rapid heat generation, thereby enabling multi-shot shooting.

This will be described in detail with reference to presented drawings.

As illustrated in FIG. 1, a support frame 1 having a structure such as a cabinet or a support is configured.

Left and right rotation supports 7 are provided on left and right sides of the lower end inside the support frame 1, respectively.

An electric motor 5 is provided on one side of the upper end inside of the support frame 1 and a fixation board 42 is provided on the front end of the electric motor 5 so that the electric motor 5 and the first rotation rod are joined or separated.

The first rotation rod 2 is wound and mounted with a screen fabric 3*a* to several meters to several hundred meters and a rotation ring 41 such as a bearing is provided on both left and right ends of the second rotation rod 4.

The first rotation bar 2 is mounted on the screen mounting board 6 and the second rotation rod 4 is mounted on the rotation support 7.

The screen fabric 3*a* of the first rotation rod 2 is wound and connected onto the second rotation rod 4.

The electric motor 5 is remotely controlled by a remote controller (not illustrated).

More specifically, the second rotation rod 4 is configured at the upper end of the support frame 1 and the motor 5 driven by the remote controller (not illustrated), or the like is provided on one side of the second rotation rod 4 and the fixation board 42 is configured, which is a separate means capable of mounting and separating the second rotation rod 4 and the motor 5 and the rotation support 7 is configured to be linked to both the left and right ends of the second rotation rod 4.

In such a structure of the present invention, the screen fabric 3*a* of the first support rod 2 is wound around the second support rod 4.

Figure 2A:
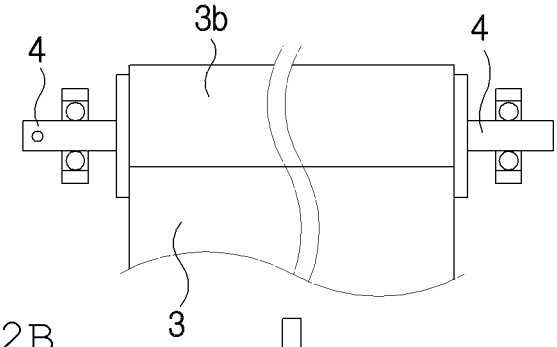
FIG. 2A is a configuration explanatory diagram of a second rotation rod.
Figure 2B:
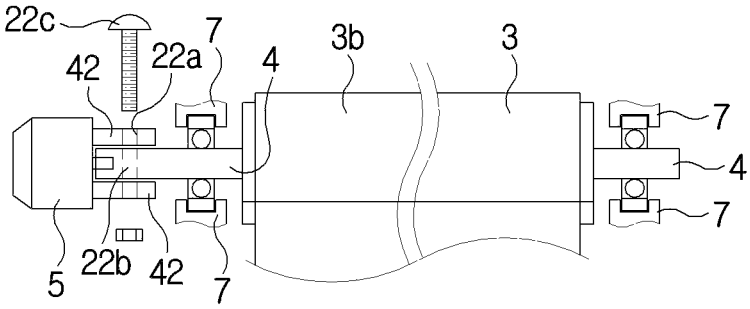
FIG. 2B is an explanatory diagram of joining and separation actions between the second rotation rod and a motor 5.

As illustrated in FIG. 2A, in a state where the rotation ring 41 is mounted on both ends of the second rotation rod 4, the second rotation rod 4 is joined to a first fixation groove 22*a* formed on the fixation board 42 of the motor 5 and a second fixation groove 22*b* of the second rotation rod 4 by a connection pin 22*c*.

When the second rotation rod 4 is separated, the second rotation rod 4 and the motor 5 are joined or separated by separating the first fixation groove 22*a* and the second fixation groove 22*b* by separating the connection pin 22*c*.

Figure 3A:
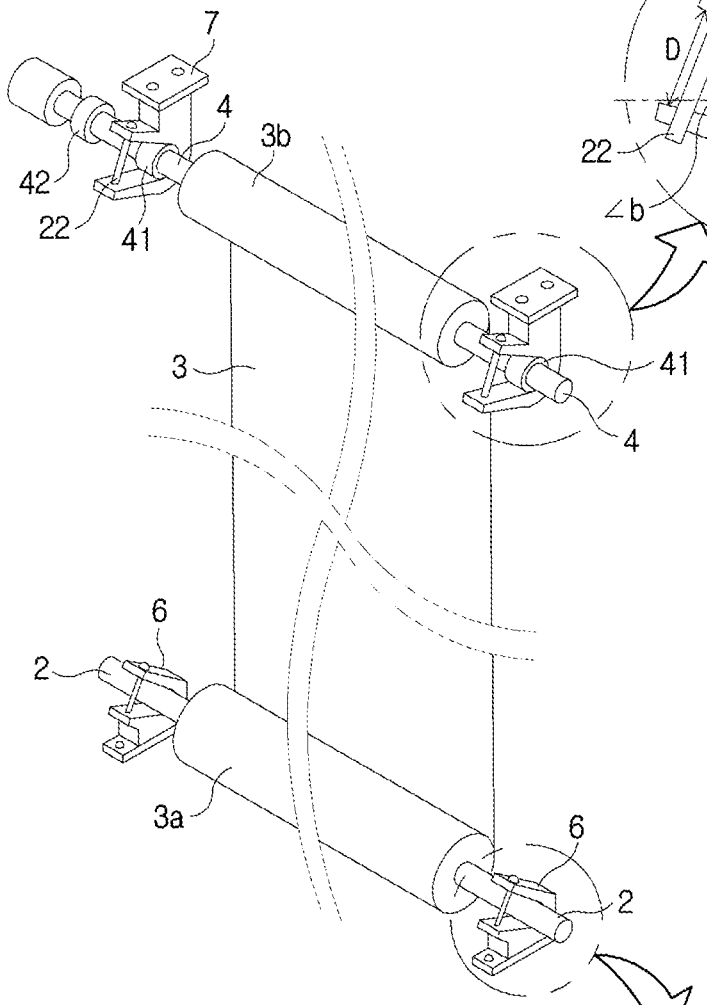
FIG. 3A is a configuration explanatory diagram of a first rotation rod and the second rotation rod.
Figure 3B:
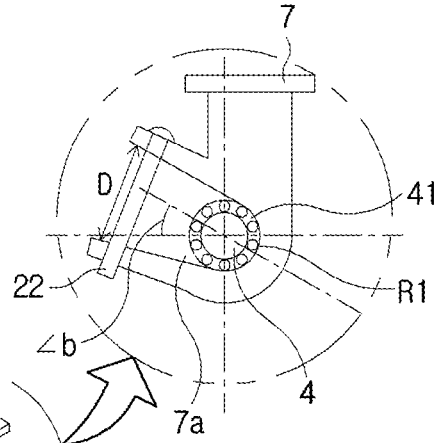
FIG. 3B is an explanatory diagram of a rotation support structure.

Both left and right rotation rings 41 of the second rotation rod 4 in the state illustrated in FIG. 2A are joined to the rotation support 7 as illustrated in FIG. 3A.

In the structure of the rotation support 7, a mounting groove 7*a* is formed inside the rotation support 7 and an inlet D1 of the mounting groove 7*a* is configured by an inclined surface having an inclination angle ∠d which decreases inward and the end of the inclined surface is formed by a curved surface having a radius of the rotation ring 41.

As illustrated in FIG. 3A, when the structure of the rotation ring 41 is mounted on both ends of the second rotation rod in left and right mounting grooves 7*a*, the rotation ring 41 rotates and moves downward along the inclination angle ∠d and seated in the mounting groove 7*a* by a weight thereof.

That is, as illustrated in FIGS. 2 and 3, when the rotation rings 41 on the left and right ends of the second rotation rod 4 are mounted on the rotation support 7, the left and right rotation rings 41 moves downward in the mounting groove 7*a* in the rotation support 7 along an inclination angle ∠b to reach a curvature R1 at the end of the mounting groove 7*a*.

The mounting groove 7*a* is finished with the safety ring 22 so that the rotation ring 41 does not come out.

The structure of the rotation ring 41 may be constituted by a bearing ring or a metal ring or a urethane ring which enables easy and smooth rotation.

As illustrated in FIG. 3A, the screen fabric 3*a* is wound around the first rotation rod 2.

Depending on the characteristic and material of the screen fabric 3*a*, the screen fabric 3*a* may be mounted up to a length of a few M and when the screen fabric 3*a* is made of the same as a thin-film material, the screen fabric 3*a* may be wound up to several (M) times.

Each of both ends of the first rotation rod 1 on which the screen fabric 3*a* is wound is mounted on a screen mounting board 6.

Figure 3C:
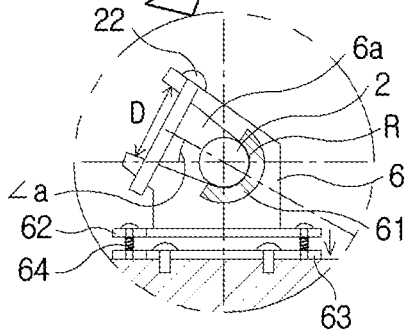
FIG. 3C is a configuration explanatory diagram of a screen mounting board.

Since the mounting groove 6*a* is configured in the screen mounting board 6 structure as illustrated in FIG. 3C, the inlet of the mounting groove 6*a* is configured to be wide and is inclined downward by the inclination angle ∠d and an internal end of the mounting groove 6*a* is formed by a curved surface R having a diameter which is equal to the diameter of the first rotation rod 2.

Therefore, when both ends of the first rotation rod 2 are pushed into the left and right mounting grooves 6*a*, the first rotation rod 2 is moved downward and fixed toward the end of the mounting groove 6*a* by the inclination angle ∠d due to the weight thereof.

A rotation braking ring 61 is formed at the position of an internal curved surface r of the mounting groove 7*a*.

The rotation braking ring 61 may be made of a urethane material having friction such that the first rotation rod 2 may not arbitrarily rotate during upward and downward movements for the purpose of replacing the screen 3 and may brake the rotation for various purposes.

For example, the rotation braking ring 61 is configured by the magnet and the first rotation rod 2 is made of a magnetic material such as iron sensitive to magnetism.

On the other hand, an impact absorption device 64 constituted by a spring or the like is configured below a pedestal 62 of the rotation support 6, and as a result, the left and right rotation supports 6 are configured to receive elastic force downward by weights thereof.

The impact absorption device 64 functions properly with the rotation braking ring 61.

That is, when a second rotary shaft winds up the screen 3, the braking device 61 appropriately controls the rotation of the first rotation rod 2 and the impact absorption device 61 is configured to appropriately apply the elastic force to force pulled in the rotation control so that the screen continuously works organically so as to maintain the flatness.

The screen fabric 3*a* of the first rotation rod 2 is unwound and wound around the upper second rotation rod 4 to form the screen 3 between the first rotation rod 2 and the second rotation rod 4.

When the screen 3 is projected to a virtual training situation coping image or the like and the screen 3 that is damaged due to the hitting is rotated by driving the motor 5 with the remote control (not illustrated), the screen 3 is rolled and in this case, a screen fabric 3*b* of the first rotation rod 2 whose rotation is appropriately controlled is released.

In this case, when the velocity of the remote controller (not illustrated) is adjusted after the screen 3 is properly wound and replaced, a buffer pad 64 and the spring below the screen mounting board 6 of the second rotation rod 4, the rotation braking ring 61, an inclination angle ∠a of the mounting groove 6*a*, and the braking ring 61 organically interact with each other to continuously maintain the flatness of the screen 3.

Further, after the screen 3 is completely used, only the safety pin 22 of the screen mounting board 6 is released and the first rotation rod 2 is separated.

When the second rotating bar 4 is separated after use, the connection pin 21 with the motor 5 is disconnected and separated from the left and right rotation supports 7.

When replacing the screen 3 with a new screen material, the second rotation rod 4 is mounted on the screen mounting board 6 and a first connection pin 22*c* is disconnected and separated from the fixation board 42 of the motor 5.

As described above, in the present invention, it is very simple to mount and separate the first and second rotation rods 2 and 4 on and from the rotation support 7 and the screen mounting board 6.

Figure 4A:
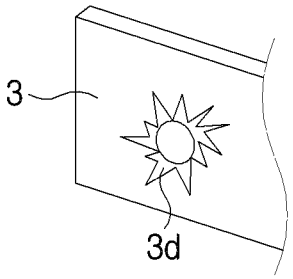
FIG. 4A is an explanatory diagram of a film screen material configuration.

As illustrated in FIG. 4A, the screen fabric 3*a* of the present invention may be made of a urethane or PET film structure.

In this case, since the urethane 3*a* is very strong in elasticity, a portion penetrated by the live ammunition may be finished with the elasticity of the urethane. Therefore, it is possible to configure the multi-shooting automatic firearm screen with a durable screen surface.

When the screen fabric 3*a* is made of a thin PET material, the screen itself may be made of a thin film of 0.2 mm or less, so that a large amount of the screen fabric 3*a* is wound around the first rotation rod 2.

Figure 4B:
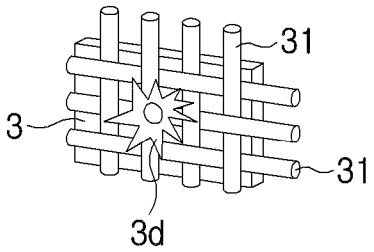
FIG. 4B is an explanatory diagram of a screen in which a reinforcing wire is buried.

As illustrated in FIG. 4B, a screen yarn 31 is configured inside the material of the screen fabric 3*a* to prevent the screen 3 from being broken even in automatic firearm shooting that shots dozens of live ammunitions, and as a result, the screen is configured to be continuously moved and maintained upward and downward.

Further, the surface of the screen fabric 3*a* illustrated in FIGS. 4A and 4B is formed by a transparent material made surface or a reflective material such as aluminum, clay, or glass beads is formed on the back surface of the screen fabric 3*a* so as to increase brightness twice or more. Therefore, the screen 3 may be configured to be usable even in a bright place.

PVC or acrylic material is applied to the surface and an aluminum reflective material is applied to the back surface to reflect the degree of polarization, so that the screen fabric 3*a* may be used as a screen structure for polarized stereoscopic images.

Therefore, it is recommended that the screen material of the present invention is made of a material that may be made into a thin film in the form of a film, but is made of a flame retardant or a flame retardant material.

Figure 7:
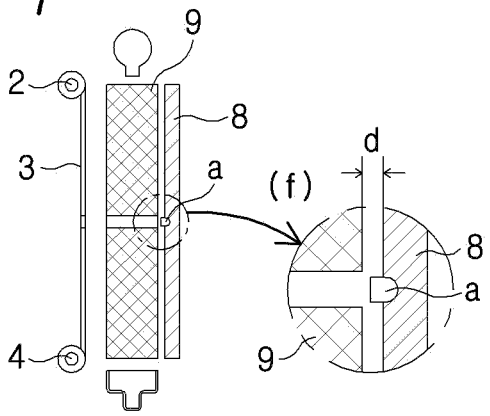
FIG. 7 is an explanatory diagram of a layout diagram of an impact absorption plate.

In the configuration of the present invention, the impact absorption plate 9, the blocking plate 8, and the cooling system 100 are formed on the back surface of the screen 3 as illustrated in FIG. 7.

The structure of the impact absorption plate 9 is configured in a form in which the porous shapes are concentrated so that the air and water may be induced into the structure as illustrated in FIGS. 8A, 8B, 8C, 8D, 8E, and 8F.

The structure of the blocking plate 8 is configured by a woven structure having flame retardancy such as a steel plate or a bullet-proof structure and a metal such as multi-layered aluminum or stainless steel so that the bullet may not penetrate the screen 3.

The structure of the impact absorption plate 9 has the block shape as illustrated in FIG. 8(*a*) and is configured in a structure in which the impact absorption plate 9 may be separately separated from the whole structure of the present invention, inserted, or replaced.

A thickness c of the impact absorption plate 9 is formed to be thicker than a length b of the live ammunition as illustrated in FIG. 8B. In the present invention, as a result of the application of a thickness of approximately 10 cm, even though the live ammunition a which passes through the impact absorption plate 3 is bounded back while being blocked by the blocking plate 8, the live ammunition a is blocked and fixed by the dense structure of the impact absorption plate 3 again, so that the live ammunition a is not made into the grenade.

Figure 8F:
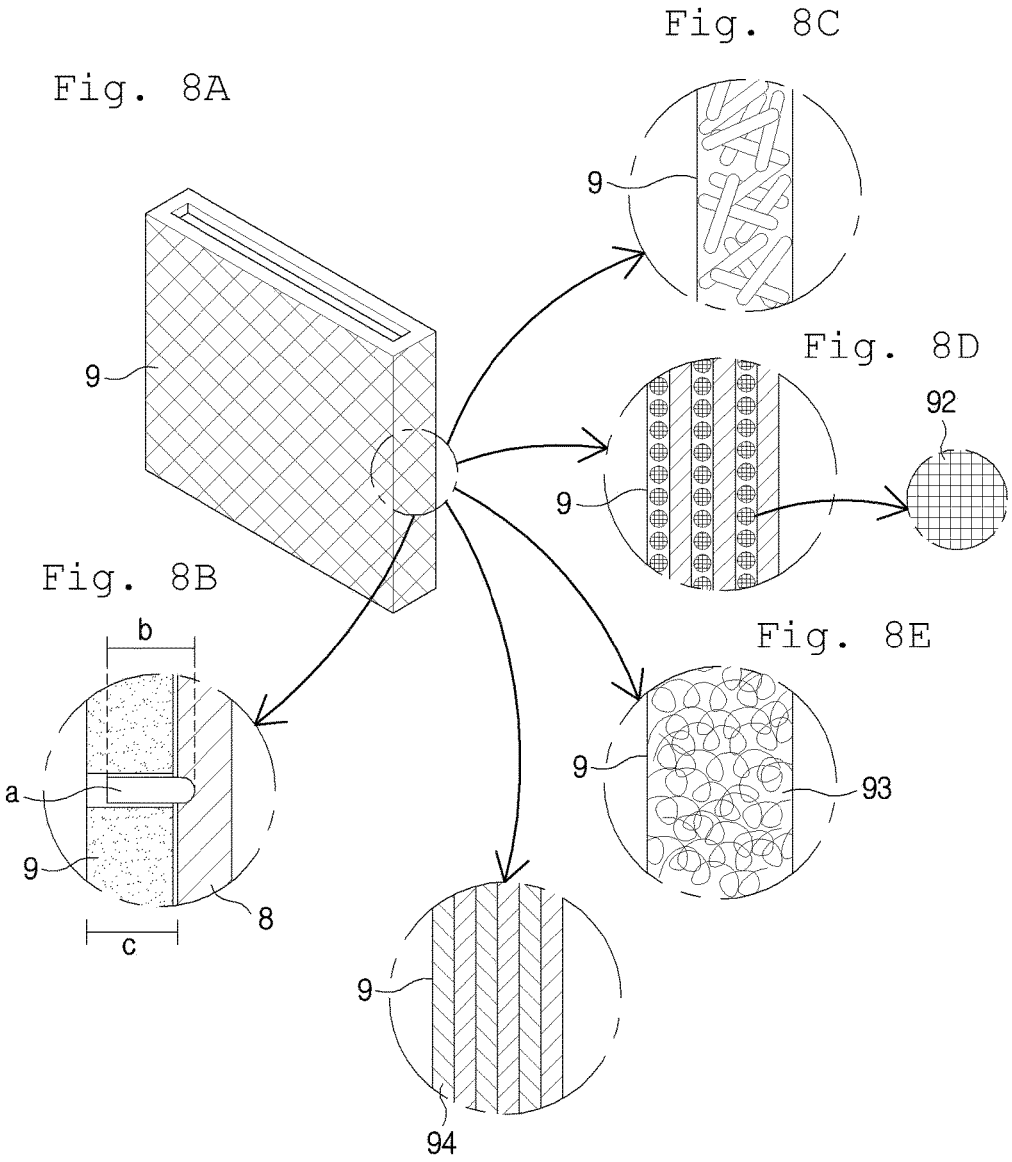
FIG. 8F is an explanatory diagram of porous embodiment 4 of the impact absorption plate.

The structure of the impact absorption plate 9 is concentrated in various shapes as illustrated in configured in FIGS. 8C, 8D, 8E, and 8F to be used in the block shape as illustrated in FIG. 8A.

In this case, a structural component is constituted by various metals such as aluminum, stainless steel, copper, alloy, etc. Iron structures, such as steel may be rusted by moisture, so the steel material may also be used in structures that do not cool or that are not likely to come in contact with the water.

Further, the iron structure may be replaced with a solid fiber with a frame retardant function, etc.

Such a function also becomes a sound absorption function when the water or air is induced and the live ammunition is blocked by the impact absorption plate 9. That is, the porous shape of the block performs a sound absorption action.

The material is not limited to the materials illustrated in FIG. 8C, but metal sludge 91 which is often output in metal processing may be used as the material. For example, a metal piece having a thickness of 0.1 mm, a width of 3 to 5 mm, and a length of 20 to 50 mm is pressed in an unbalanced direction and in the block shape as illustrated in FIG. 8A to form the block.

As illustrated in FIG. 8D, a cross knitting network 92 is made of such a material to be configured in double layers.

As illustrated in FIG. 8E, a steel wool as used in a metal scrubber is compressed and is made into the block, and as a result, the impact absorption plate is made of steel 93.

FIG. 8F and flame-retarded nylon, polyester, cotton, and the like are knitted to be configured in multiple layers and the air or water may be configured to be induced therebetween.

Fabric type poplin, reinforced plastic and aluminum pieces, nylon material, ceramic material, and the like require high hardness and need to absorb energy of the bullet which flies rapidly. Bulletproof fibers having strong tensile force and elastic force with a net shape and elastic force are piled up in layers to absorb energy every time the bullet passes through the bulletproof fiber.

A high-speed sharp special bullet penetrates the bulletproof fiber. To prevent the penetration of the bullet, a fiber material is attached with a hard material such as ceramics, etc. to disperse the energy of the bullet.

The bulletproof fiber is made of materials with high impact energy absorbing power such as Kevork, Twaron, Spectra, Arimide, and several tens of layers of polyethylene.

That is, the materials used in FIGS. 7 and 8C, 8D, 8E, and 8F are stainless steel, steel, alloy, ceramic, reinforced plastic, poplin, Twaron, Spectra, Aramid, Polyethylene, etc. which absorb the energy of the bullet every time the bullet penetrates the bulletproof fiber.

In the present invention, since several tends of hot bullets or more may be simultaneously at the short distance, the impact absorption plate 9 receiving the bullets is inevitably heated. Therefore, a cooling structure is required to prevent fire.

Since the structure of the impact absorption plate 9 is not a single body but a structure in which multiple metal sludge is compressed in the block shape as illustrated in FIG. 8C or overlapped in the shape of the net 92 as illustrated in FIG. 8D or the metallic material is pressed in the porous shape as illustrated in FIG. 8E or multiple knitting structures are overlapped as illustrated in FIG. 8F, as illustrated in FIGS. 8C, 8D, 8E, and 8F, the internal structure of the block is configured in the porous (3L) shape. Therefore, the moisture, the air, etc. are induced.

Figure 9A:
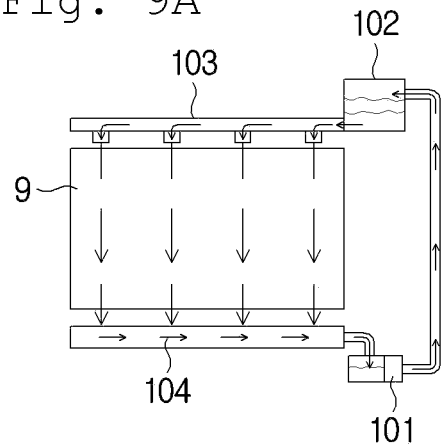
FIG. 9A is an explanatory diagram of embodiment 1 of a cooling system.

In the present invention, cooling water pipes 103 are formed on the upper end of the impact absorption plate 8 as illustrated in FIG. 9A to inject the water on the impact absorption plate 8 at an appropriate interval and constitute a water tank 102 that supplies the water.

A water inducing plate 104 for collecting cooling water which flows down from the upper portion is formed in the lower portion of the impact absorption plate 9 and one side of the water inducing plate 104 is connected with a pump 101.

The pump 101 is connected with the water tank 102 thereabove again. When the pump 101 is actuated while the shooting training, the water in the pump 101 is supplied to the upper water tank 102 and the water in the water tank 102 flows into multiple porous structures in the impact absorption plate 9 through the cooling water pipe 103 to cool the heat absorbed by the impact absorption plate 9 by the heat of the bullet.

Figure 9B:
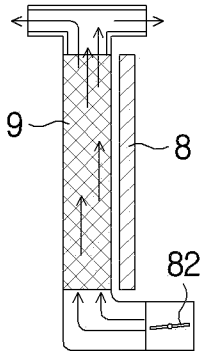
FIG. 9B is an explanatory diagram of embodiment 2 of the cooling system.

As illustrated in FIG. 9B, a cooling fan 82 is formed below the impact absorption plate 8 and the air is forcibly injected to the porous structure in the impact absorption plate 8 structure to cool the impact absorption plate 8.

Figure 9C:
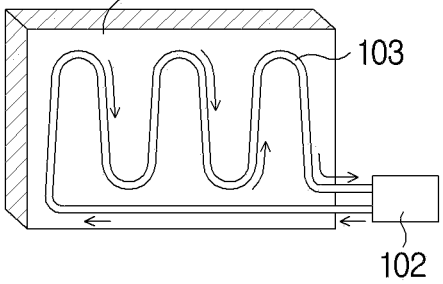
FIG. 9C is an explanatory diagram of embodiment 3 of the cooling system.

As illustrated in FIG. 9C, the structure of the blocking plate 8 in close contact with the structure of the impact absorption plate 8 is made of a metal plate having good thermal conductivity and is connected to a cooling device 102 such as an air conditioner on the back surface of the blocking plate 8 and joined with a cooling conductivity pipe 103 to simultaneously cool the impact absorption plate 8 in close contact with the blocking plate 8.

Figure 9D:
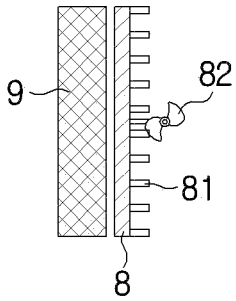
FIG. 9D is an explanatory diagram of embodiment 4 of the cooling system.

As illustrated in FIG. 9D, a heat dissipation plate 81 having various bent and wing shapes are formed on the back surface of the blocking plate 8 in close contact with the impact absorption plate 9 to cool the heat of the impact absorption plate 9 heated by the bullet a and a cooling fan 82 may be additionally configured as necessary.

As illustrated in FIG. 8B, the structure of the present invention is configured such that the impact absorption plate 9 and the blocking plate 8 are spaced apart from each other at appropriate intervals.

In such a configuration, the bullet a of which energy is exhausted while penetrating the screen 3 and passing through the impact absorption plate 9 is blocked by the blocking plate 8.

That is, even if the bullet which hits the blocking plate 8 is reflected and becomes the grenade, the bullet is blocked by the impact absorption plate 9 to fall into an interval d.

That is, in the present invention, even if the bullet is incident at an angle, regardless of the angle of incidence of the bullet, the bullet which has once passed through the impact absorption plate 9 is blocked by the impact absorption plate 9 even though the bullet becomes the grenade by a reflection angle in the blocking plate 8.

Therefore, the shock absorbing plate 9 of the present invention is configured to have a porous structure and the impact absorption plate 9 absorbs the energy of the bullet a penetrating the screen at the high speed and the progress of the bullet a is stopped and fixed together with the structure of the blocking plate 8 to prevent the bullet a from being the grenade and rapidly absorb and disperse the heat of the bullet a.

Further, the structure of the blocking plate 8 made of a material such as a steel plate, steel, ceramics, reinforced plastic or the like stops the progress of the bullet a penetrating the structure of the impact absorption plate 9.

In addition, the structure of the cooling system 100 joined to the impact absorption plate 9 or the blocking plate 8 rapidly cools the heat of the impact absorption plate 9 heated by the heat of the bullet a which is incident successively or multiply to enable successive or multiple shooting in the live ammunition shooting training.

Therefore, in the present invention, since the flatness is maintained even after use, various moving pictures and images of the projector are measured by focusing on an accurate image by a measurement device such as a camera, or the like and the image for each of various situations may be provided and the screen is easily immediately replaced, therefore, a hitting video screen which needs to be immediately replaced may be used as a hitting video screen.

Figure 5:
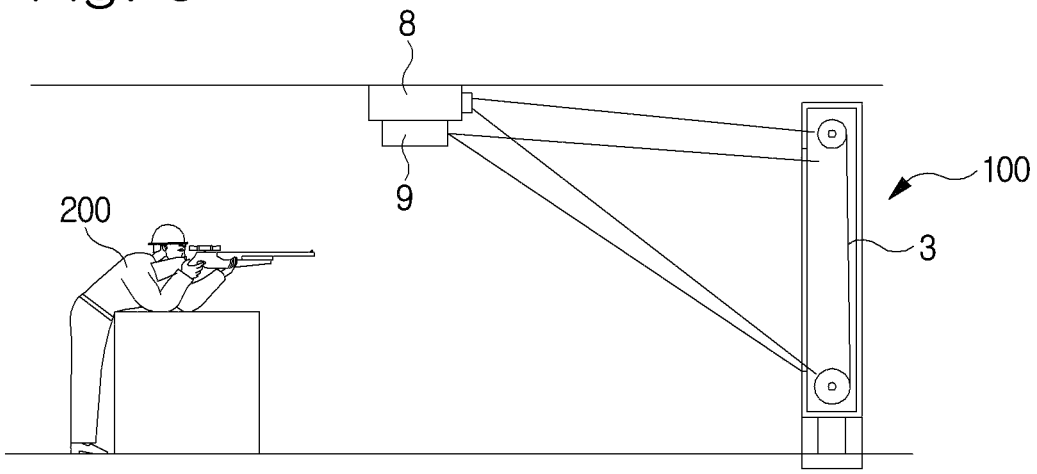
FIG. 5 is a configuration explanatory diagram when the present invention is used.

As illustrated in FIG. 5, an image observation device 9 such as a known projector 8 or the camera is configured at a front end using the screen as the structure of the present invention to perform shooting with respect to an actual image of various virtual training situations projected by the projector and the actual shooting image is observed by the image observation device 9 such as the camera, or the like.

Figure 6:
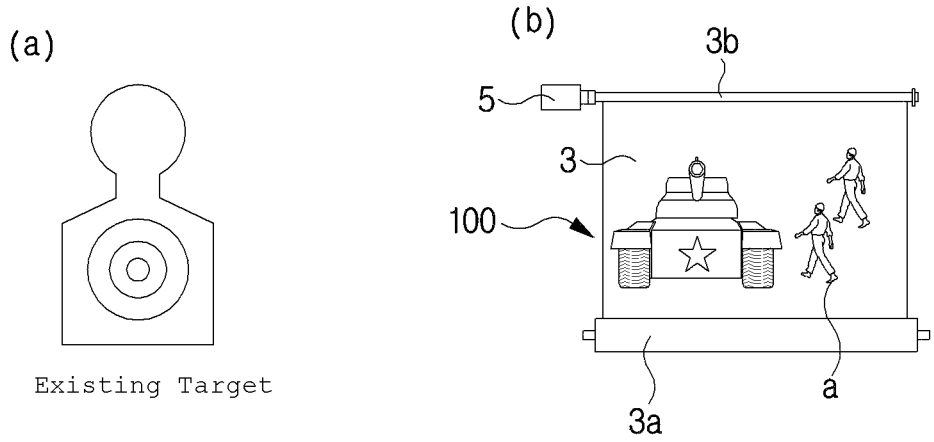
FIG. 6 is an explanatory diagram of comparison of a moving picture by screen flatness.

However, according to the present invention, since the screen is fixed as described above and the image focus is correctly made and various virtual training images may thus be provided instead of the simple target in the related art as illustrated in FIG. 6, the screen may also be applied to response shooting trainings including screen golf, screen baseball, bow shooting, automatic firearm shooting, live ammunition shooting, clay shooting, terror situations, and the like.

Figure 10A:
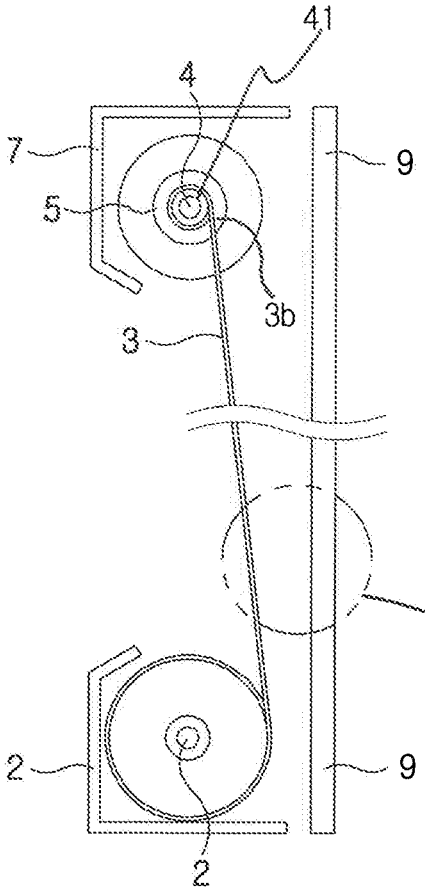
FIG. 10A is a configuration explanatory diagram when shooting for an arrow.

As illustrated in FIG. 10A, in the present invention, only the impact absorption plate 9 may be provided and used according to the purpose as illustrated in FIG. 9A.

Figure 10B:
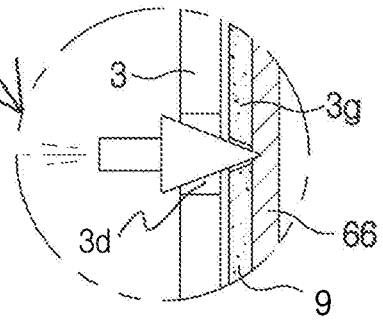
FIG. 10B is an action explanatory diagram when shooting for the arrow.

That is, as illustrated in FIG. 10B, when the impact absorption plate 9 is used as an arrow target, the impact absorption plate 9 is provided on the back surface of the screen 3 with a part of an arrowhead, for example, an elastic material having the arrowhead length or less and the back surface thereof is finished with a steel plate material 66.

In this case, after the arrowhead passes through the screen 3 and thereafter, passes through the impact absorption plate 9, the arrowhead is blocked by the steel plate material 66 to fix the progress of the arrow.

What is claimed is:

1. A virtual training video screen apparatus for shooting live ammunitions, comprising:
   - a first rotation rod on which fabrics of projection screens are wound;
   - a second rotation rod for rolling up the projection screen in a vertical direction;
   - a screen mounting board for mounting and separating the first rotation rod;
   - a rotation support for mounting and separating the second rotation rod;
   - an impact absorption plate provided behind the projection screens configured in a way to absorb heat and energy of a shot bullet which is incident in the screen by configuring a back surface of the projection screens in a porous incombustible structure; and
   - a blocking plate provided on the back surface of the impact absorption plate to block the progress of the shot bullet.

2. The virtual training video screen apparatus for shooting live ammunitions of claim 1, wherein a cooling means is joined to a structure of the impact absorption plate or the structure of the blocking plate.

3. The virtual training video screen apparatus for shooting live ammunitions of claim 1, wherein shapes of mounting grooves formed in the screen mounting board and the rotation support are formed by an inclined surface having a downward angle.

4. The virtual training video screen apparatus for shooting live ammunitions of claim 1, wherein a braking ring such as a magnetic body is provided at an end of a mounting groove of the screen mounting board.

5. The virtual training video screen apparatus for shooting live ammunitions of claim 1, wherein a buffer device for generating elasticity is configured below the projection screens mounting board and the buffer device and the braking ring interact with each other to maintain flatness of the projection screens.

6. The virtual training video screen apparatus for shooting live ammunitions of claim 1, wherein the fabric of the projection screens is made of a film material.

7. The virtual training video screen apparatus for shooting live ammunitions of claim 1, wherein an aluminum reflection surface is formed on the surface of the fabric of the projection screens to display a stereoscopic image.

* * * * *